US008928436B2

(12) United States Patent
Hirabayashi

(10) Patent No.: US 8,928,436 B2
(45) Date of Patent: Jan. 6, 2015

(54) ELECTROMAGNETIC SWITCH FOR STARTER

(71) Applicant: Denso Corporation, Kariya, Aichi-pref. (JP)

(72) Inventor: Takashi Hirabayashi, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/132,857

(22) Filed: Dec. 18, 2013

(65) Prior Publication Data

US 2014/0167892 A1 Jun. 19, 2014

(30) Foreign Application Priority Data

Dec. 19, 2012 (JP) ..... 2012-276540

(51) Int. Cl.

| | |
|---|---|
| ***H01H 67/02*** | (2006.01) |
| ***H01F 7/13*** | (2006.01) |
| ***H01H 50/02*** | (2006.01) |
| ***H01H 51/06*** | (2006.01) |
| *H01H 9/04* | (2006.01) |

(52) U.S. Cl.

CPC ..... *H01H 50/023* (2013.01); *H01H 51/065* (2013.01); *H01H 9/041* (2013.01)

USPC ..... 335/131; 335/274

(58) Field of Classification Search

USPC ..... 335/131–132, 274

See application file for complete search history.

(56) References Cited

U.S. PATENT DOCUMENTS

| | | | | |
|---|---|---|---|---|
| 4,604,597 | A * | 8/1986 | Bogner et al. | 335/127 |
| 4,755,781 | A * | 7/1988 | Bogner | 335/131 |
| 6,799,746 | B2 * | 10/2004 | Schafer | 251/129.07 |
| 2006/0132268 | A1 | 6/2006 | Hirabayashi | |

FOREIGN PATENT DOCUMENTS

JP A-2006-177160 7/2006

* cited by examiner

*Primary Examiner* — Ramon Barrera
(74) *Attorney, Agent, or Firm* — Oliff PLC

(57) ABSTRACT

An electromagnetic switch for a starter. The electromagnetic switch includes a cylindrical slidable member that is separate from a plunger, loosely encompasses an outer circumferential periphery of a plunger rod, and is axially movable integrally with the plunger. Whether the solenoid is in its active or inactive state, the slidable member is at least partially axially inserted into an inner circumferential periphery of a cylindrical bore and an outer circumferential periphery of the slidable member is entirely circumferentially in sliding contact with the inner circumferential periphery of the cylindrical bore.

4 Claims, 4 Drawing Sheets

ELECTROMAGNETIC SWITCH FOR STARTER

CROSS-REFERENCE TO RELATED APPLICATION

This application is based on and claims the benefit of priority from earlier Japanese Patent Applications No. 2012-276540 filed Dec. 19, 2012, the descriptions of which are incorporated herein by reference.

BACKGROUND

1. Technical Field

The present invention relates to a starter electromagnetic switch for opening and closing a main contact provided on a starter motor circuit to thereby switch on and off motor energization current.

2. Related Art

A known starter electromagnetic switch, as disclosed in Japanese Patent Application Laid-Open Publication No. 2006-177160, includes a solenoid configured to form an electromagnet through energization of a coil to drive a plunger by means of an attractive force of the electromagnet, and a movable contact attached to an end of a plunger rod secured to the plunger. The movable contact is arranged in opposition to a pair of fixed contacts electrically connected to a starter motor circuit. The movable contact moves in the axial direction of the plunger integrally therewith in response to ON/OFF operation of the solenoid (i.e., excited/unexcited state of the coil) to thereby electrically connect and disconnect the pair of fixed contacts.

The electromagnetic switch disclosed in Japanese Patent Application Laid-Open Publication No. 2006-177160 includes a contact compartment on the anti-plunger side of a fixed iron core to be magnetized by the electromagnet, in which compartment the pair of fixed contacts and the movable contact are arranged. More specifically, the fixed iron core has a cylindrical bore located radially centrally therein. The plunger rod extends through the bore, and the end portion of the plunger rod resides in the contact compartment. In addition, a contact pressure spring is provided on the outer circumferential periphery of the plunger rod to bias the movable contact. To install the contact pressure spring inside the inner diameter of the bore without interference with the fixed iron core, the inner diameter of the bore is set greater than the outer diameter of the contact pressure spring.

In the above configuration, however, a spatial gap between the inner diameter of the cylindrical bore in the fixed iron core and the outer diameter of the plunger rod may lead to fluid communication between a plunger movement space in which the plunger can axially move (hereinafter referred to as a plunger compartment) and the contact compartment, so that moisture is prone to intrude from the plunger compartment into the contact compartment. Hence, for example, when the outside temperature falls below freezing, the moisture that has intruded into the contact compartment may freeze to contact surfaces of the fixed contacts and/or the movable contact. This may lead to conduction defects between these contacts during operation of the electromagnetic switch. To prevent such conduction defects, ice produced on the contact surfaces has to be broken by contact bombardment upon contact of the movable contact with the fixed contacts, which requires increasing the attractive force of the solenoid to thereby enhance the contact bombardment upon contact. This, however, gives rise to a disadvantage that the outer diameter of the electromagnetic switch will be increased.

In consideration of the foregoing, it would therefore be desirable to have a starter electromagnetic switch capable of minimizing intrusion of moisture from a plunger compartment into a contact compartment to reduce an attractive force of a solenoid and thereby reduce both size and weight of the switch.

SUMMARY

In accordance with an exemplary embodiment of the present invention, there is provided an electromagnetic switch for a starter, including: a main contact provided on a motor circuit for the starter and configured to interrupt energization current to a motor; and a solenoid configured to open and close the main contact in response to ON/OFF operation of an electromagnet. The solenoid includes: a coil configured to form the electromagnet through energization; a plunger movable axially on an inner circumferential periphery of the coil; a fixed iron core disposed on an axial side of the plunger and having a cylindrical bore that is a through-hole passing through the fixed iron core axially in its radial center, the fixed iron core being configured to be magnetized by the electromagnet; and a plunger rod extending axially through an inner circumferential periphery of the cylindrical bore and having an axial plunger side end portion secured to the plunger so as to be movable integrally with the plunger.

The main contact includes: a pair of fixed contacts disposed in a contact compartment formed on an axial anti-plunger side of the fixed iron core, the pair of fixed contacts being electrically connected to the motor circuit; and a movable contact attached to an axial anti-plunger side end portion of the plunger rod passing through the cylindrical bore and projecting into the contact compartment, the movable contact being axially movable integrally with the plunger so as to electrically connect and disconnect the pair of fixed contacts, thereby turning on and off the motor circuit.

The electromagnetic switch further includes a cylindrical slidable member that is separate from the plunger, loosely encompasses an outer circumferential periphery of the plunger rod, and is axially movable integrally with the plunger, the slidable member being at least partially axially inserted into the inner circumferential periphery of the cylindrical bore whether the solenoid is in its active or inactive state, and an outer circumferential periphery of the slidable member being entirely circumferentially in sliding contact with the inner circumferential periphery of the cylindrical bore.

With this configuration, whether the solenoid is in its active or inactive state, the outer circumferential periphery of the slidable member is entirely circumferentially in sliding contact with the inner circumferential periphery of the cylindrical bore. That is, the slidable member and the cylindrical bore overlap each other in the radial direction. As such, there is substantially no clearance between the outer circumferential periphery of the slidable member and the inner circumferential periphery of the cylindrical bore, which provides hermeticity between the plunger compartment (an inner space of the solenoid in which the plunger is axially movable) and the contact compartment. This can minimize intrusion of moisture from the plunger compartment into the contact compartment. Hence, even if a little moisture that has intruded from the plunger compartment into the contact compartment freezes to contact faces of the fixed contacts and/or the movable contact, a film of ice will not grow. This allows a breaking force required to break the ice on the contact faces of the fixed contacts and/or the movable contact to be reduced. It is therefore unnecessary to increase an attractive force of the solenoid required to break the ice on the contact faces of the fixed contacts and/or the movable contact.

In the electromagnetic switch as configured above, the presence of sliding contact portions of the outer circumferential periphery of the plunger and the outer circumferential periphery of the slidable member may cause the plunger and the slidable member to be off-center from each other when the solenoid is in its active state. To this, the slidable member is configured to be a separate member from the plunger and loosely encompass the outer circumferential periphery of the plunger rod. Hence, even when the plunger and the slidable member are off-center from each other, the slidable member is radially movable with radial play. This can prevent prying of the plunger and the plunger rod due to the plunger and the slidable member being off-center from each other, thereby preventing increase of sliding resistance.

Since attractive forces of the solenoid can be reduced as compared to the electromagnetic switch as disclosed in Japanese Patent Application Laid-Open Publication No. 2006-177160, the outer diameter of the solenoid is allowed to be reduced, which leads to reduction of both size and weight of the electromagnetic switch.

DESCRIPTION OF SPECIFIC EMBODIMENTS

The present invention will be described more fully hereinafter with reference to the accompanying drawings.

First Embodiment

There will now be explained a starter including an electromagnetic switch in accordance with one embodiment of the present invention.

Figure 4:
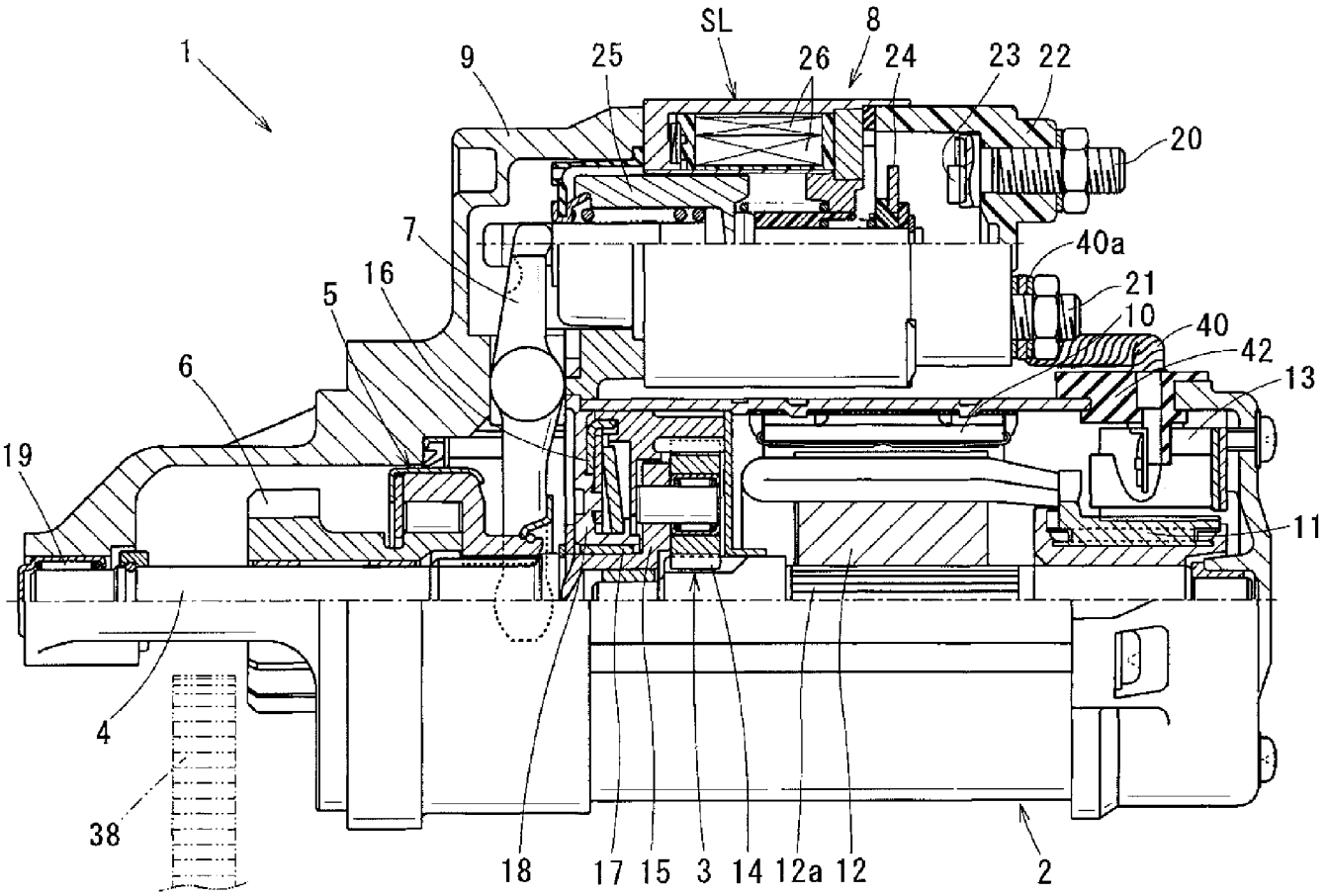
FIG. 4 is a cross-sectional view of a starter in accordance with the present invention.

The starter 1, as shown in FIG. 4, includes a motor 2 that receives supplied power to generate a torque, a speed reducer 3 that reduces a rotation speed of the motor 2, a shock absorber (described later) that absorbs excessive shock transmitted from an engine, an output shaft 4 to which the generated torque is transferred from the motor 2 via the speed reducer 3, a pinion 6 disposed along the output shaft 4 integrally with a clutch 5, an electromagnetic switch 8 that drives a shift lever 7 to push the pinion 6 in the anti-plunger direction (to the left as viewed in FIG. 4) and opens and closes a main contact (described later) to thereby interrupt energization current to the motor 2, and a housing 9 in which the motor 2 and the electromagnetic switch 8 are mounted.

The motor 2 is a direct-current (DC) commutator motor including a magnetic-field generator 10 that generates a magnetic field (which may be an electromagnet field although FIG. 4 illustrates a permanent magnet field), an armature 12 having a commutator 11, and brushes 13 disposed on an outer circumference of the commutator 11.

The speed reducer 3 is a well-known planetary reducer including a plurality of planetary gears 14 that receive a rotational force of the armature 12 to rotate and revolve on its own axes. The revolutions of the planetary gears 14 are transmitted to the output shaft 4 via a planetary carrier 15.

The shock absorber includes a friction plate 16 that is rotatably restrained by frictional forces, and is configured such that, when excessive shock is transmitted from the engine to the speed reducer 3, the friction plate 16 slides or rotates against the frictional forces, thereby aborting the shock.

The output shaft 4 is disposed in line with an armature axis 12*a* of the motor 2, where a first axial side portion of the output shaft 4 is integral with the planetary carrier 15 of the speed reducer 3 and rotatably supported by a center casing 18 through a bearing 17 and a second axial side portion of the output shaft 4 is rotatably supported by the housing 9 through a bearing 19.

The clutch 5 is helical-splined onto an outer circumferential periphery of the output shaft 4 and serves as a unidirectional clutch such that the rotation of the output shaft 4 is transmitted to the pinion 6 while torque transfer from the pinion 6 to the output shaft 4 is interrupted. The pinion 6 is integral with the clutch 5 and movably disposed on and along the output shaft 4 together with the clutch 5.

There will now be explained a configuration of the electromagnetic switch 8 with reference to FIG. 1.

In the following, the first axial side and the second axial side respectively refer to the right hand side (terminal bolt side or anti-plunger side) and the left hand side (solenoid case side or plunger side), as viewed in the drawings, in the axial direction of the electromagnetic switch 8 (i.e., the horizontal direction as viewed in the drawings).

The electromagnetic switch 8 includes a resin cover 22 to which two terminal bolts 20, 21 are secured, a pair of fixed contacts 23 electrically connected to the motor circuit via the two terminal bolts 20, 21, a movable contact 24 to electrically connect and disconnect the pair of fixed contacts 23, a solenoid SL to drive the movable contact 24, and others. The solenoid SL includes a metallic solenoid case 25, which also serves as a magnetic circuit, and a solenoid unit (described later) inserted into the solenoid case 25.

The solenoid case 25 is bottomed and cylindrically-shaped with its first axial side portion being open and its second axial side portion including an annular bottom 25*a*. The solenoid case 25 is secured to the housing 9 through two studs (not shown) secured to the annular bottom 25*a* of the solenoid case 25 (see FIG. 4).

The solenoid unit includes a coil 26 configured to form an electromagnet through energization, an annular fixed plate 27 disposed adjacent to the coil 26 on the first axial side of the coil 26, a fixed iron core 28 press-fitted into the inner circumferential periphery of the fixed plate 27 so as to be integral with the fixed plate 27, a plunger 29 disposed on the second axial side of the fixed iron core 28 and movable axially on the inner circumferential periphery of the coil 26, a plunger rod 30 secured to the plunger 29, a return spring 31 disposed between the fixed iron core 28 and the plunger 29, and a slidable member 32 (described later), and others.

The coil 26 includes a pull-in coil 26*a* that generates an electromagnetic force to pull therein the plunger 29, and a hold-in coil 26*b* that generates an electromagnetic force to hold therein the pulled-in plunger 29. The coil 26 is in a double-layer configuration such that the pull-in coil 26*a* is wound around a resin bobbin 33 and the hold-in coil 26*b* is wound around the pull-in coil 26*a*.

The fixed plate 27 may be a stack of a plurality of metallic plates (e. g., iron plates) formed by a ferromagnetic material. A circumferential peripheral portion of the second axial side surface of the fixed plate 27 is in contact with a stepped face formed on the inner circumferential periphery of the solenoid case 25. The fixed plate 27 is not limited to such a stack of metallic plates. Alternatively, the fixed plate 27 may be a single metallic plate that is thick in the axial direction.

The fixed iron core 28 is also formed by a ferromagnetic material, such as iron or the like, as in the fixed plate 27, and is magnetized together with the fixed plate 27 through the formation of the electromagnet. The fixed iron core 28 has a through-hole passing therethrough axially in its radial center and having a circular cross-section (hereinafter referred to as a cylindrical bore 28*a*). The second axial side end face of the fixed iron core 28, facing the plunger 29, includes an annular attaching face adapted to attract the plunger 29 when the fixed iron core 28 is magnetized, and an inner circumferential periphery portion recessed slightly from the annular attaching surface, which is hereinafter referred to as an iron-core recess. The cylindrical bore 28*a* is opened radially centrally in the iron-core recess on the second axial side of the fixed iron core 28.

The plunger 29 is inserted into an inner circumferential periphery of a cylindrical sleeve 34 disposed inwardly of the bobbin 33. The plunger 29 is movable axially with use of the cylindrical sleeve 34 as a guide surface. The first axial side end face of the plunger 29, facing the fixed iron core 28, includes an annular contact face adapted to be in contact with the attaching face of the fixed iron core 28 when the plunger 29 is attracted by the magnetized iron core 28, and an inner portion recessed slightly from the annular contact surface, which is hereinafter referred to as a plunger recess. On the second axial side of the plunger 29 is opened a bottomed cylindrical bore.

The plunger rod 30 is provided integrally with a flange 30*a* on the second axial side of the plunger rod 30. The flange 30*a* is secured to the plunger recess by means of welding or bonding using an adhesive. The plunger rod 30 axially extends through the cylindrical bore 28*a*, and the anti-plunger side end portion of the plunger rod 30 resides in the contact compartment 35 formed inside the resin cover 22.

The first axial side end of the return spring 31 is supported on an end face of the iron-core recess and the second axial side end of the return spring 31 is supported on an end face of the plunger recess, so that the plunger 29 is biased in the anti-iron-core direction (e. g, the left direction as viewed in the drawings). A joint 36 and a drive spring 37 disposed on an outer circumferential periphery of the joint 36 are inserted in a cylindrical bore formed in the plunger 29, where the joint 36 is adapted to transmit axial movement of the plunger 29 to a shift lever 7.

The joint 36 is provided with a flange 36*a* on its first axial side such that the flange 36*a* is pushed against the bottom of the cylindrical bore by reaction force of the drive spring 37. The drive spring 37 is compressed while the plunger 29 is attracted by the magnetized iron core 28, thereby storing a repulsive force for shifting the pinion 6 into the ring gear 38 (see FIG. 4).

An open end portion of the resin cover 22 is inserted into an open end portion of the solenoid case 25 through a sealing member (not shown), such as an O-ring or the like, and attached to the fixed plate 27 through a rubber packing 39. The resin cover 22 is secured to the solenoid case 25 by crimping the open end portion of the solenoid case 25 over a stepped portion formed on an outer circumferential periphery of the resin cover 22.

Two terminal bolts 20, 21 include a B-terminal bolt 20 electrically connected to a vehicle battery (not shown) through a cable, and a M-terminal bolt 21 connected to a terminal 40*a* for a motor lead wire 40 (see FIG. 4), where the B-terminal bolt 20 and the M-terminal bolt 21 are secured to the resin cover 22 via their respective washers 41. As shown in FIG. 4, an anti-terminal side end portion of the motor lead wire 40 is retracted inside the motor 2 through a grommet 42 so as to be electrically connected to positive brushes 13.

Bolt heads of the respective bolts 20, 21 are arranged in the contact compartment 35, and secured to their respective fixed contacts 23 by welding or the like.

Figure 1:
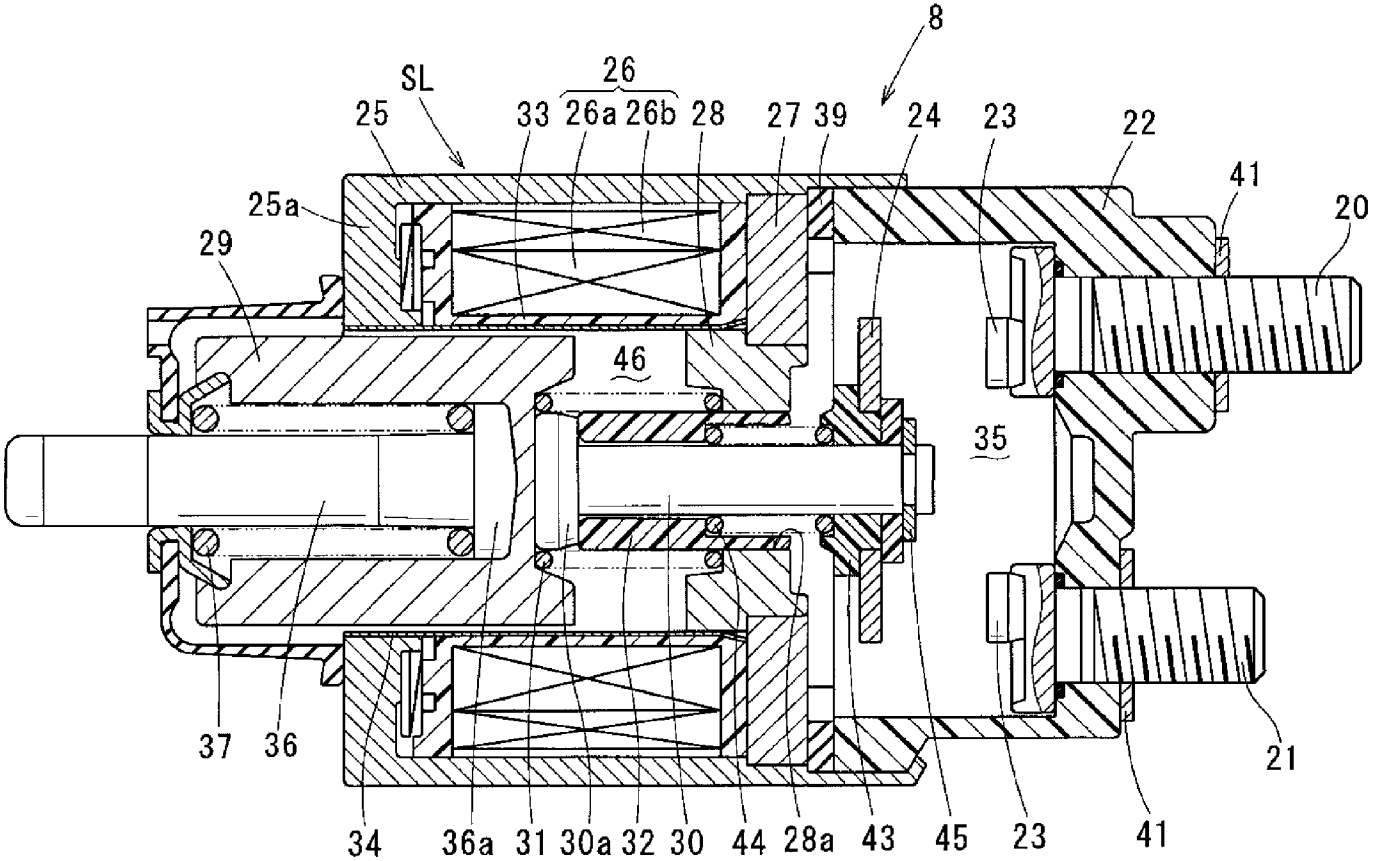
FIG. 1 is a cross-sectional view of an electromagnetic switch in accordance with one embodiment of the present invention.

The movable contact 24 is axially movably supported by an end portion of the plunger rod 30 projecting into the interior of the contact compartment 35 through an insulating member 43 and is biased by a contact pressure spring 44 toward the end portion of the plunger rod 30 (rightward in FIG. 1). A washer 45 is secured to the end portion of the plunger rod 30 so as to prevent the movable contact 24 from being withdrawn from the plunger rod 30.

The main contact set forth above is formed of the pair of fixed contacts 23 and the movable contact 24. In operation, when the movable contact 24 is biased into contact with the pair of fixed contacts 23 under contact pressure of the contact pressure spring 44, then the main contact is closed (i.e., the switch is turned on). Meanwhile, when the movable contact 24 leaves the pair of fixed contacts 23 and electrical connection therebetween is thereby interrupted, then the main contact is opened (i.e., the switch is turned off).

The contact pressure spring 44 is axially disposed on an outer circumferential periphery of the plunger rod 30, where one end of the contact pressure spring 44 on its anti-movable-contact side is supported by a slidable member 32.

There will now be explained the slidable member 32.

The slidable member 32 may be formed by a resin material having a high level of self-lubricating properties to be cylindrically-shaped and separate from the plunger 29. A resin material having a higher degree of crystallinity, such as polyacetal, polyamide or the like, has a higher level of self-lubricating properties.

Figure 2:
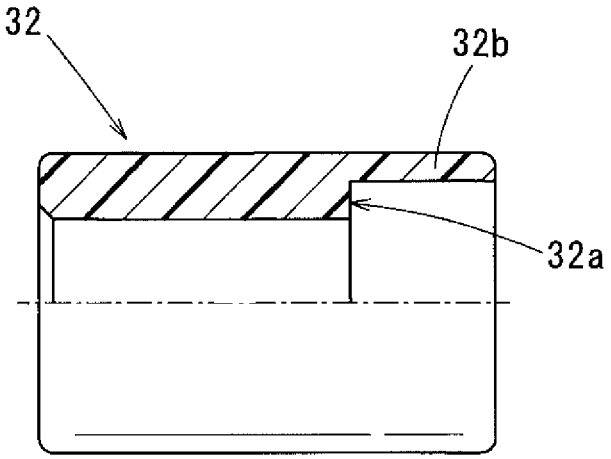
FIG. 2 is a half cross-sectional view of a slidable member in accordance with the embodiment of FIG. 1.

The slidable member 32, as shown in FIG. 2, has an equal outer diameter over the entire length in the axial direction (horizontal direction as viewed in drawings). The outer diameter of the slidable member 32 is slightly less than an inner diameter of the cylindrical bore 28*a* so that the outer circumferential periphery of the slidable member 32 can be in sliding contact with the inner circumferential periphery of the cylindrical bore 28*a*, that is, the outer circumferential periphery of the slidable member 32 is axially slidably in contact with the inner circumferential periphery of the cylindrical bore 28*a*.

Meanwhile, an inner circumferential periphery of the slidable member 32 is stepped axially such that an inner diameter of a portion of the slidable member 32 on the first axial side (right hand side as viewed in drawings) of a stepped face 32*a* is greater than an inner diameter of a portion of the slidable member 32 on the second axial side (left hand side as viewed in drawings) of the stepped face 32*a*. The stepped face 32*a* serves as a spring receiving surface that receives an anti-movable-contact-side end of the contact pressure spring 44 such that the inner diameter of the first axial side portion of the slidable member 32 is slightly greater than an outer diameter of the contact pressure spring 44. As shown in FIG. 1, the slidable member 32 loosely encompasses the outer circumferential periphery of the plunger rod 30, and a second axial side end of the slidable member 32 is pushed against the flange 30*a* of the plunger rod 30 by reaction forces of the contact pressure spring 44, which allows the slidable member 32 to be axially and integrally movable with the plunger 29.

A second axial side (anti-movable-contact side) end portion of the contact pressure spring 44 is inserted into the first axial side inner circumferential periphery of the slidable member 32. The inserted end portion of the contact pressure spring 44 is supported on the spring receiving surface 32*a* of the slidable member 32. The cylindrical portion of the slidable member 32 on the first axial side of the spring receiving surface 32*a* is hereinafter referred to as a spring guide portion 32*b*.

Figure 3:
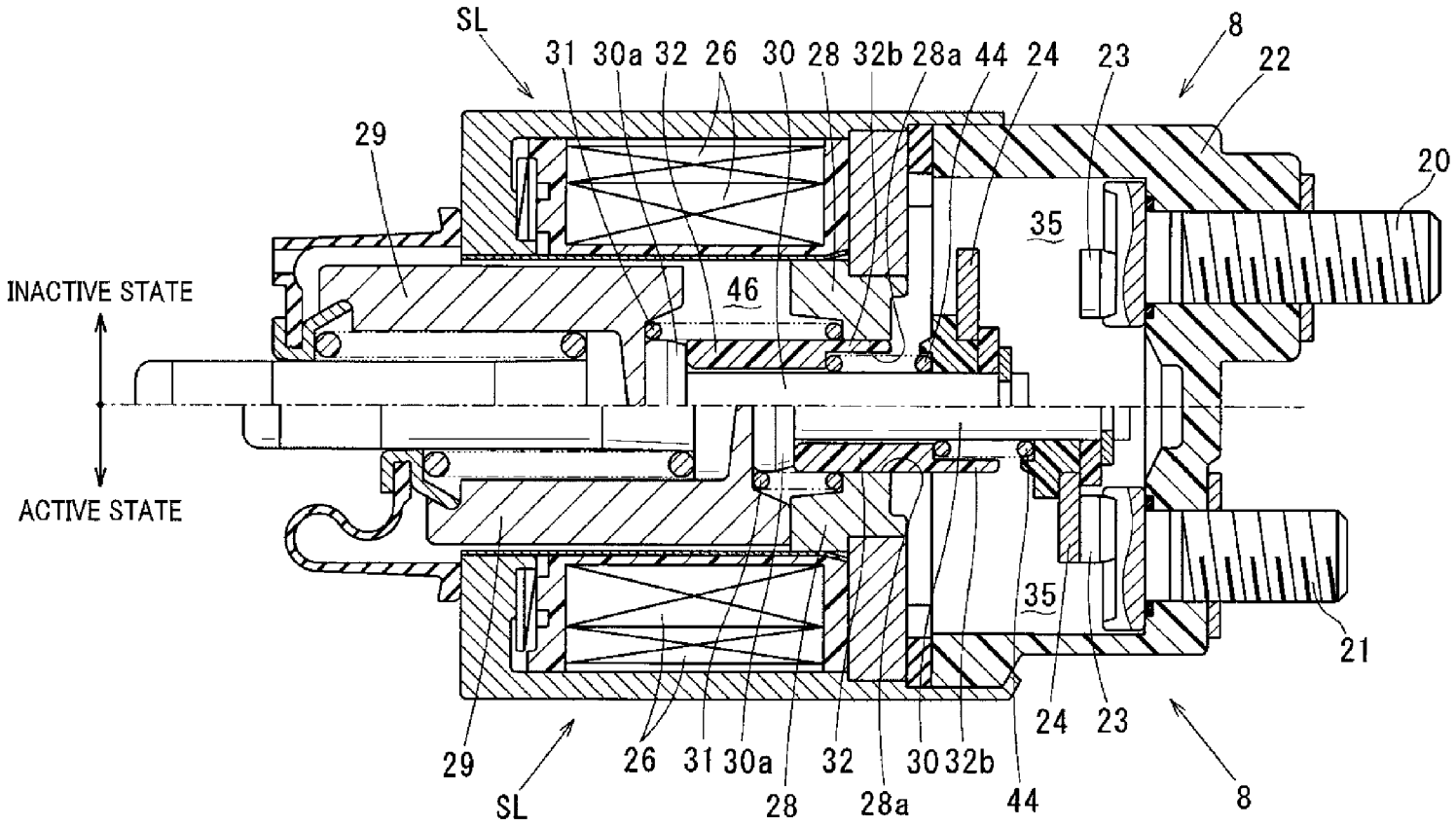
FIG. 3 is a cross-sectional view of the electromagnetic switch during active and inactive states in accordance with the embodiment of FIG. 1.

As shown in FIG. 3, whether the solenoid SL is in its active or inactive state, the slidable member 32 is at least partially axially inserted into the inner circumferential periphery of the cylindrical bore 28*a* and the outer circumferential periphery of the slidable member 32 is entirely circumferentially in sliding contact with the inner circumferential periphery of the cylindrical bore 28*a* (at least at a point along the axial direction). That is, the slidable member 32 and the cylindrical bore 28*a* overlap each other in the radial direction. It should be noted that the upper half of FIG. 3 shows the electromagnetic switch 8 in its inactive state (in which the solenoid is OFF), and the lower half of FIG. 3 shows the electromagnetic switch 8 in its active state (in which the solenoid is ON).

There will now be explained the operation of the electromagnetic switch 8.

When the fixed iron core 28 is magnetized upon formation of the electromagnet through energization of the coil 26, then the plunger 29 is magnetically attracted to the fixed iron core 28 while compressing the return spring 31. The axial movement of the plunger 29 toward the fixed iron core 28 causes the pinion 6 to be pushed in the anti-motor direction integrally with the clutch 5 via the shift lever 7. Upon contact of a flank of the pinion 6 with a flank of the ring gear 38, the axial movement of the pinion 6 is stopped.

Meanwhile, once the plunger rod 30 is pushed in the first axial side direction in conjunction with the movement of the plunger 29, the movable contact 24 supported by the plunger rod 30 encounters the pair of fixed contacts 23. In addition, once the contact face of the plunger 29 is attracted to the attaching face of the fixed iron core 28, the movable contact 24 is pushed against the pair of fixed contacts 23 by a repulsive force stored in the contact pressure spring 44, so that the main contact is closed (i.e., the switch is turned on).

Once the main contact is turned on, electrical power is supplied from the battery to the motor 2, which leads to generation of a torque in the armature 12. The generated torque is amplified in the speed reducer 3. The amplified torque is transmitted to the output shaft 4, and the output shaft 4 thus rotates. The rotation of the output shaft 4 is transmitted to the pinion 6 via the clutch 5. The pinion 6 thus rotates to be engaged with the ring gear 38 at an engagement-enabled rotational position under influence of a reactive force stored in the drive spring 37. Thus, the torque, originating from the motor 2, amplified in the speed reducer 3 is transmitted from the pinion 6 to the ring gear 38, thereby cranking the engine to be started.

Once the engine has started through cranking, energization of the coil 26 is terminated, which causes the electromagnet to be deactivated. Thereafter, the plunger 29 is pushed back in the anti-fixed-iron-core direction under influence of a reactive force stored in the return spring 31. The pinion 6 is disengaged from the ring gear 38 in conjunction of the movement of the plunger 29. At the same time, the movable contact 24 leaves the pair of fixed contacts 23, so that the main contact is opened (i.e., the switch is turned off). The power supply from the battery to the motor 2 is thereby interrupted.

Advantages

In the present embodiment, the electromagnetic switch 8 includes the cylindrically-shaped slidable member 32 that loosely encompasses the outer circumferential periphery of the plunger rod 30. As shown in FIG. 3, whether the solenoid SL is in its active or inactive state, the slidable member 32 is at least partially axially inserted into the inner circumferential periphery of the cylindrical bore 28*a* and the outer circumferential periphery of the slidable member 32 is entirely circumferentially in sliding contact with the inner circumferential periphery of the cylindrical bore 28*a*. With this configuration, there is substantially no clearance between the outer circumferential periphery of the slidable member 32 and the inner circumferential periphery of the cylindrical bore 28*a*, which provides hermeticity between the plunger compartment 46 (that is an inner space of the solenoid SL in which the plunger 29 is axially movable) and the contact compartment 35. This can minimize intrusion of moisture from the plunger compartment 46 into the contact compartment 35. Hence, even if a little moisture that has intruded from the plunger compartment 46 into the contact compartment 35 freezes to contact faces of the fixed contacts 23 and/or the movable contact 24, a film of ice will not grow. This allows a breaking force required to break the ice on the contact faces of the fixed contacts 23 and/or the movable contact 24 to be reduced. That is, it is unnecessary to increase an attractive force of the solenoid SL required to break the ice on the contact faces of the fixed contacts 23 and/or the movable contact 24.

In the present embodiment, the electromagnetic switch 8 as set forth above is configured such that the outer circumferential periphery of the plunger 29 is in sliding contact with the inner circumferential periphery of the cylindrical sleeve 34 and the outer circumferential periphery of the slidable member 32 is in sliding contact with the inner circumferential periphery of the cylindrical bore 28*a*. The presence of these sliding contact portions of the outer circumferential periphery of the plunger 29 and the outer circumferential periphery of the slidable member 32 may cause the plunger 29 and the slidable member 32 to be off-center from each other. To this, the slidable member 32 loosely encompasses the outer circumferential periphery of the plunger rod 30 (that is, there is radial clearance between the inner circumferential periphery of the slidable member 32 and the outer circumferential periphery of the plunger rod 30), is separate from the plunger 29, and is not secured to plunger 29. With this configuration, even when the plunger 29 and the slidable member 32 are off-center from each other, the slidable member 32 is radially movable with radial play up to the clearance between the slidable member 32 and of the plunger rod 30. This can prevent prying of the plunger 29 and the plunger rod 30 due to the plunger 29 and the slidable member 32 being off-center from each other, thereby preventing increase of sliding resistance.

Since attractive forces of the solenoid SL can be reduced as compared to the electromagnetic switch as disclosed in Japanese Patent Application Laid-Open Publication No. 2006-177160, the outer diameter of the solenoid SL is allowed to be reduced, which leads to reduction of both size and weight of the electromagnetic switch.

In addition, in the present embodiment, the slidable member 32 is urged against the flange 30*a* of the plunger rod 30 under load of the contact pressure spring 44. This can prevent the slidable member 32 that is separate from the plunger 29 from sliding axially on the outer circumferential periphery of the plunger rod 30. That is, no additional dedicated component for retaining the slidable member 32 in the axial direction is required to be provided, and the existing contact pressure spring 44 is allowed to be used to urge the slidable member 32 against the flange 30*a* of the plunger rod 30 to retain the slidable member 32 in the axial direction. This leads to reduction of both size and weight of the electromagnetic switch 8 at a lower expense.

Further, the second axial side (anti-movable-contact side) end portion of the contact pressure spring 44 is inserted into the first axial side inner circumferential periphery of the slidable member 32. The inserted end portion of the contact pressure spring 44 is supported on the spring receiving surface 32*a* of the slidable member 32. That is, the outer circumferential periphery of the inserted end portion of the contact pressure spring 44 is encompassed by the spring guide portion 32*b* of the slidable member 32. This can reliably prevent the end of the contact pressure spring 44 from moving out of the spring receiving surface 32*a*, which enhances reliability in operation of the movable contact 24.

In some alternative embodiments, the contact pressure spring 44 may be arranged in series with the slidable member 32. That is, the inserted end portion of the contact pressure spring 44 is supported not on the spring receiving surface 32*a* of the slidable member 32, but on the first axial side end face of the slidable member 32. In such embodiments, however, the slidable member 32 and the contact pressure spring 44 don't overlap each other in the radial direction, which causes a mounted position of the contact pressure spring 44 to be greatly shifted toward the contact compartment 35. This may increase an axial length of the contact compartment 35.

In the present embodiment, the electromagnetic switch 8 is configured such that the slidable member 32 and the contact pressure spring 44 overlap each other in the radial direction. This can prevent the contact pressure spring 44 from reaching far into the contact compartment 35. That is, partial insertion of the contact pressure spring 44 into the inner circumferential periphery of the first axial side portion of the slidable member 32 allows the contact pressure spring 44 to be positioned so as to overlap the fixed iron core 28 in the radial direction at least when the solenoid SL is in its inactive state. With this configuration, an axial length of the contact compartment 35 can be reduced as compared to the alternative embodiments where the contact pressure spring 44 may be arranged in series with the slidable member 32. This leads to reduction of the entire axial length of the electromagnetic switch 8.

In addition, in the present embodiment, the slidable member 32 is formed by a resin material that is non-magnetic. This can prevent magnetic flux leakage from the slidable member 32, thereby preventing reduction of attractive forces of the solenoid SL. Further, forming the slidable member 32 by using a resin material to thereby reduce weight of the electromagnetic switch 8 can prevent increase of attractive forces of the solenoid SL even in such a configuration that the slidable member 32 moves integrally with the plunger 29. Still further, forming the slidable member 32 by using a resin material having a high level of self-lubricating properties can reduce sliding resistance when the slidable member 32 moves axially within the inner circumferential periphery of the cylindrical bore 28*a* in conjunction with movement of the plunger 29. In particular, as described above, the set forth feature that the sliding resistance can be reduced even in such a configuration that the outer circumferential periphery of the plunger 29 is in sliding contact with the inner circumferential periphery of the cylindrical sleeve 34 and the outer circumferential periphery of the slidable member 32 is in sliding contact with the inner circumferential periphery of the cylindrical bore 28*a* allows for reduction of attractive forces of the solenoid SL.

Modifications

In the above embodiment, the slidable member 32 is formed by a resin material having self-lubricating properties. Alternatively, the slidable member 32 may be formed by any non-magnetic material having self-lubricating properties. Still alternatively, the outer circumferential periphery of the slidable member 32 may be subject to surface treatment for providing self-lubricating properties.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An electromagnetic switch for a starter, comprising:

a main contact provided on a motor circuit for the starter and configured to interrupt energization current to a motor; and a solenoid configured to open and close the main contact in response to ON/OFF operation of an electromagnet, the solenoid comprising:

a coil configured to form the electromagnet through energization;

a plunger movable axially on an inner circumferential periphery of the coil;

a fixed iron core disposed on an axial side of the plunger and having a cylindrical bore that is a through-hole passing through the fixed iron core axially in its radial center, the fixed iron core being configured to be magnetized by the electromagnet; and a plunger rod extending axially through an inner circumferential periphery of the cylindrical bore and having an axial plunger side end portion secured to the plunger so as to be movable integrally with the plunger, wherein the main contact comprises:

a pair of fixed contacts disposed in a contact compartment formed on an axial anti-plunger side of the fixed iron core, the pair of fixed contacts being electrically connected to the motor circuit; and a movable contact attached to an axial anti-plunger side end portion of the plunger rod passing through the cylindrical bore and projecting into the contact compartment, the movable contact being axially movable integrally with the plunger so as to electrically connect and disconnect the pair of fixed contacts, thereby turning on and off the motor circuit;

a cylindrical slidable member that is separate from the plunger, loosely encompasses an outer circumferential periphery of the plunger rod, and is axially movable integrally with the plunger, the slidable member being at least partially axially inserted into the inner circumferential periphery of the cylindrical bore whether the solenoid is in its active or inactive state, and an outer circumferential periphery of the slidable member being entirely circumferentially in sliding contact with the inner circumferential periphery of the cylindrical bore; and a contact pressure spring disposed on an outer circumferential periphery of the plunger rod, the contact pressure spring being configured to urge the movable contact against the pair of fixed contacts to be in contact therewith when the main contact is closed, wherein:

the slidable member includes a spring receiving surface adapted to support an axial plunger side end portion of the contact pressure spring such that the slidable member is retained on the axial plunger side of the plunger rod under load of the contact pressure spring, an inner circumferential periphery of the slidable member includes an axially stepped face serving as the spring receiving surface, and an inner diameter of the slidable member on an axial anti-plunger side of the stepped face is greater than an inner diameter of the slidable member on an axial plunger side of the stepped face, whereby at least an axial plunger side end portion of the contact pressure spring is inserted into the inner circumferential periphery of the slidable member on the axial anti-plunger side of the stepped face and the inserted end portion of the contact pressure spring is supported on the spring receiving surface of the slidable member.

2. An electromagnetic switch for a starter, comprising:

a main contact provided on a motor circuit for the starter and configured to interrupt energization current to a motor; and a solenoid configured to open and close the main contact in response to ON/OFF operation of an electromagnet, the solenoid comprising:

a coil configured to form the electromagnet through energization;

a plunger movable axially on an inner circumferential periphery of the coil;

a fixed iron core disposed on an axial side of the plunger and having a cylindrical bore that is a through-hole passing through the fixed iron core axially in its radial center, the fixed iron core being configured to be magnetized by the electromagnet; and a plunger rod extending axially through an inner circumferential periphery of the cylindrical bore and having an axial plunger side end portion secured to the plunger so as to be movable integrally with the plunger, wherein the main contact comprises:

a pair of fixed contacts disposed in a contact compartment formed on an axial anti-plunger side of the fixed iron core, the pair of fixed contacts being electrically connected to the motor circuit; and a movable contact attached to an axial anti-plunger side end portion of the plunger rod passing through the cylindrical bore and projecting into the contact compartment the movable contact being axially movable integrally with the plunger so as to electrically connect and disconnect the pair of fixed contacts, thereby turning on and off the motor circuit;

a cylindrical slidable member that is separate from the plunger, loosely encompasses an outer circumferential periphery of the plunger rod, and is axially movable integrally with the plunger, the slidable member being at least partially axially inserted into the inner circumferential periphery of the cylindrical bore whether the solenoid is in its active or inactive state, and an outer circumferential periphery of the slidable member being entirely circumferentially in sliding contact with the inner circumferential periphery of the cylindrical bore; and a contact pressure spring disposed on an outer circumferential periphery of the plunger rod, the contact pressure spring being configured to urge the movable contact against the pair of fixed contacts to be in contact therewith when the main contact is closed, wherein:

the slidable member includes a spring receiving surface adapted to support an axial plunger side end portion of the contact pressure spring such that the slidable member is retained on the axial plunger side of the plunger rod under load of the contact pressure spring, the plunger rod comprises a flange on its axial plunger side, the flange being secured to the plunger, the slidable member is urged against the flange of the plunger rod under load of the contact pressure spring so that an axial plunger side end face of the slidable member is in contact with the flange of the plunger rod, an inner circumferential periphery of the slidable member includes an axially stepped face serving as the spring receiving surface, and an inner diameter of the slidable member on an axial anti-plunger side of the stepped face is greater than an inner diameter of the slidable member on an axial plunger side of the stepped face, whereby at least an axial plunger side end portion of the contact pressure spring is inserted into the inner circumferential periphery of the slidable member on the axial anti-plunger side of the stepped face and the inserted end portion of the contact pressure spring is supported on the spring receiving surface of the slidable member.

3. An electromagnetic switch for a starter, comprising:

a main contact provided on a motor circuit for the starter and configured to interrupt energization current to a motor; and a solenoid configured to open and close the main contact in response to ON/OFF operation of an electromagnet, the solenoid comprising:

a coil configured to form the electromagnet through energization;

a plunger movable axially on an inner circumferential periphery of the coil;

a fixed iron core disposed on an axial side of the plunger and having a cylindrical bore that is a through-hole passing through the fixed iron core axially in its radial center, the fixed iron core being configured to be magnetized by the electromagnet; and a plunger rod extending axially through an inner circumferential periphery of the cylindrical bore and having an axial plunger side end portion secured to the plunger so as to be movable integrally with the plunger, wherein the main contact comprises:

a pair of fixed contacts disposed in a contact compartment formed on an axial anti-plunger side of the fixed iron core, the pair of fixed contacts being electrically connected to the motor circuit; and a movable contact attached to an axial anti-plunger side end portion of the plunger rod passing through the cylindrical bore and projecting into the contact compartment, the movable contact being axially movable integrally with the plunger so as to electrically connect and disconnect the pair of fixed contacts, thereby turning on and off the motor circuit;

a cylindrical slidable member that is separate from the plunger, loosely encompasses an outer circumferential periphery of the plunger rod, and is axially movable integrally with the plunger, the slidable member being at least partially axially inserted into the inner circumferential periphery of the cylindrical bore whether the solenoid is in its active or inactive state and an outer circumferential periphery of the slidable member being entirely circumferentially in sliding contact with the inner circumferential periphery of the cylindrical bore; and a contact pressure spring disposed on an outer circumferential periphery of the plunger rod, the contact pressure spring being configured to urge the movable contact against the pair of fixed contacts to be in contact therewith when the main contact is closed, wherein the slidable member includes a spring receiving surface adapted to support an axial plunger side end portion of the contact pressure spring such that the slidable member is retained on the axial plunger side of the plunger rod under load of the contact pressure spring, an inner circumferential periphery of the slidable member includes an axially stepped face serving as the spring receiving surface, an inner diameter of the slidable member on an axial anti-plunger side of the stepped face is greater than an inner diameter of the slidable member on an axial plunger side of the stepped face, whereby at least an axial plunger side end portion of the contact pressure spring is inserted into the inner circumferential periphery of the slidable member on the axial anti-plunger side of the stepped face and the inserted end portion of the contact pressure spring is supported on the spring receiving surface of the slidable member, and the contact pressure spring is positioned on the outer circumferential periphery of the plunger rod so as to overlap the fixed iron core in a radial direction at least when the solenoid is in its inactive state.

4. An electromagnetic switch for a starter, comprising:

a main contact provided on a motor circuit for the starter and configured to interrupt energization current to a motor; and a solenoid configured to open and close the main contact in response to ON/OFF operation of an electromagnet, the solenoid comprising:

a coil configured to form the electromagnet through energization;

a plunger movable axially on an inner circumferential periphery of the coil;

a fixed iron core disposed on an axial side of the plunger and having a cylindrical bore that is a through-hole passing through the fixed iron core axially in its radial center, the fixed iron core being configured to be magnetized by the electromagnet; and a plunger rod extending axially through an inner circumferential periphery of the cylindrical bore and having an axial plunger side end portion secured to the plunger so as to be movable integrally with the plunger, wherein the main contact comprises:

a pair of fixed contacts disposed in a contact compartment formed on an axial anti-plunger side of the fixed iron core, the pair of fixed contacts being electrically connected to the motor circuit; and a movable contact attached to an axial anti-plunger side end portion of the plunger rod passing through the cylindrical bore and projecting into the contact compartment the movable contact being axially movable integrally with the plunger so as to electrically connect and disconnect the pair of fixed contacts, thereby turning on and off the motor circuit;

a cylindrical slidable member that is separate from the plunger, loosely encompasses an outer circumferential periphery of the plunger rod, and is axially movable integrally with the plunger, the slidable member being at least partially axially inserted into the inner circumferential periphery of the cylindrical bore whether the solenoid is in its active or inactive state, and an outer circumferential periphery of the slidable member being entirely circumferentially in sliding contact with the inner circumferential periphery of the cylindrical bore; and a contact pressure spring disposed on an outer circumferential periphery of the plunger rod, the contact pressure spring being configured to urge the movable contact against the pair of fixed contacts to be in contact therewith when the main contact is closed, wherein the slidable member includes a spring receiving surface adapted to support an axial plunger side end portion of the contact pressure spring such that the slidable member is retained on the axial plunger side of the plunger rod under load of the contact pressure spring, the plunger rod comprises a flange on its axial plunger side, the flange being secured to the plunger, the slidable member is urged against the flange of the plunger rod under load of the contact pressure spring so that an axial plunger side end face of the slidable member is in contact with the flange of the plunger rod, an inner circumferential periphery of the slidable member includes an axially stepped face serving as the spring receiving surface, an inner diameter of the slidable member on an axial anti-plunger side of the stepped face is greater than an inner diameter of the slidable member on an axial plunger side of the stepped face, whereby at least an axial plunger side end portion of the contact pressure spring is inserted into the inner circumferential periphery of the slidable member on the axial anti-plunger side of the stepped face and the inserted end portion of the contact pressure spring is supported on the spring receiving surface of the slidable member, and the contact pressure spring is positioned on the outer circumferential periphery of the plunger rod so as to overlap the fixed iron core in a radial direction at least when the solenoid is in its inactive state.

* * * * *